US006112768A

United States Patent [19]

Rath et al.

[11] Patent Number: 6,112,768

[45] Date of Patent: Sep. 5, 2000

[54] IN-LINE FLUID AGITATOR

[76] Inventors: Leslie B. Rath; Harvey E. Deering, both of c/o 549 Spencer Street, S.E., Medicine Hat, Alberta, Canada, T1A 1Y8

[21] Appl. No.: 09/288,072

[22] Filed: Apr. 8, 1999

[51] Int. Cl.[7] ..... F15D 1/02; B01F 5/06

[52] U.S. Cl. ..... 138/39; 138/46; 366/338

[58] Field of Search ..... 138/37, 39, 46; 366/338

[56] References Cited

U.S. PATENT DOCUMENTS

| | | | |
|---|---|---|---|
| 193,845 | 8/1877 | Bedell | 138/46 |
| 2,601,616 | 6/1952 | Kasten | 138/46 |
| 3,367,362 | 2/1968 | Hoffman | 138/46 |
| 3,489,172 | 1/1970 | Whitmore | 138/46 |
| 3,550,912 | 12/1970 | Melnikov et al. | 259/4 |
| 4,067,361 | 1/1978 | Hollister et al. | 138/42 |
| 4,448,538 | 5/1984 | Mantel | 138/26 |
| 5,069,191 | 12/1991 | Scouten . | |
| 5,123,591 | 6/1992 | Reynolds | 138/108 |
| 5,148,794 | 9/1992 | Scouten . | |
| 5,582,210 | 12/1996 | Bartholomew | 138/46 |
| 5,740,837 | 4/1998 | Chiang | 138/37 |

*Primary Examiner*—James Hook
*Attorney, Agent, or Firm*—Bennett Jones LLP

[57] ABSTRACT

An in-line agitating device for fluids includes an elongate internally-threaded cylindrical tube, open at each end, with a flow-disturber such as a round ball positioned inside the tube so as to substantially but not completely block off the bore of the tube. When a fluid is introduced into one end of the tube, its velocity increases as it is forced through the restricted space between the ball and the inner surface of the tube and then rapidly decelerates, causing turbulence which results in vigorous agitation of the fluid. This agitation is intensified by swirling action imparted to the fluid by the internal threading of the tube.

10 Claims, 3 Drawing Sheets

IN-LINE FLUID AGITATOR

FIELD OF THE INVENTION

The present invention relates to devices for agitating and mixing fluids, and relates in particular to agitating devices installed in fuel lines for internal combustion engines.

BACKGROUND OF THE INVENTION

It has long been known that combustion of gasoline and diesel fuel in internal combustion engines produces a variety of air-polluting by-products including hydrocarbons and carbon monoxide. Such pollution can cause serious health problems for humans and animals alike, and is generally considered to be a factor contributing to "global warming" due to the "greenhouse effect".

Practically speaking, pollution from internal combustion engines cannot be entirely eliminated or prevented, but it can be reduced. The amount of pollutants an engine produces depends on how cleanly and efficiently the engine burns the fuel. It is therefore highly desirable to develop new ways of improving the efficiency with which fuels are burned in internal combustion engines.

U.S. Pat. No. 5,069,191, issued to Scouten on Dec. 3, 1991, and U.S. Pat. No. 5,148,794, issued to Scouten on Sep. 22, 1992, disclose related attempts to improve the efficiency of internal combustion engines. The Scouten patents teach devices which may be installed in the fuel lines of a vehicle to agitate the fuel before it is introduced into the engine of the vehicle. Any of the Scouten devices may be summarily described as a tube having inside it a flow divider which causes fuel passing through the device to be diverted, agitated, and swirled around before proceeding on to the engine.

Tests performed on vehicles fitted with the Scouten devices reportedly indicated reductions in carbon monoxide and hydrocarbons in the exhaust emissions from the vehicles, as compared to emissions from the same vehicles before the devices were fitted thereon. The Scouten patents state the belief that the agitation and mixing action caused by the devices results in molecular disturbances in the fuel which promote more efficient combustion.

While they may be capable of producing beneficial effects, the Scouten devices have significant drawbacks in that they entail complicated fabrication, and to close manufacturing tolerances. They are correspondingly expensive to make, and therefore less readily accessible to vehicle owners having limited financial resources.

Accordingly, there is a need for a fuel mixing and agitating device which can be installed in the fuel lines of internal combustion engines to promote cleaner combustion and reduced production of air-polluting by-products, while at the same time being simpler in construction and therefore more economical to manufacture than known devices having similar purposes.

BRIEF SUMMARY OF THE INVENTION

In one aspect, the present invention is an in-line fluid agitator comprising:

(a) an elongate cylindrical tube having an outer surface and a rough-textured inner surface, and having an inlet end and an outlet end;

(b) a flow-disturber positioned within the tube between the inlet end and the outlet end, substantially but not completely blocking off the bore of the tube;

(c) retaining means for holding the flow-disturber in a desired position within the tube;

(d) an inflow chamber, being the space between the inlet end of the tube and the flow-disturber;

(e) a mixing chamber, being the space between the flow-disturber and the outlet end of the tube; and (f) means for providing fluid-tight connection of the inlet end and outlet end of the tube to a fluid inlet supply line and a fluid outflow line respectively.

In the preferred embodiment, the rough-textured inner surface is provided by internally threading the tube. In one particular preferred embodiment, the inner surface of the tube is machined to a standard "National Fine" thread.

Also in the preferred embodiment, the flow-disturber is a round metal ball having a diameter slightly smaller than the inside diameter of the tube. It is believed that the invention works most effectively when the diameter of the metal ball is 0.014 inches smaller than the inside diameter of the tube, plus or minus 0.002 inches. For example, it has been found that when using a metal ball with a diameter of 7/16" (0.4375 inches), the bore of the tube should be in a range between 0.4495 inches and 0.4535 inches. Similarly, if using a metal ball with a diameter of ½" (0.500 inches), the bore of the tube should be in a range between 0.512 inches and 0.516 inches.

In the preferred embodiment, the retaining means is composed of two helical spring elements sized and configured so that they can engage the internal threads and thus can be screwed into the tube. At one end of each spring element there is a tab disposed radially inward, such that the spring elements may be positioned inside the tube, one on either side of the metal ball, with the tab of each spring element abutting the metal ball and preventing it from being displaced.

BRIEF DESCRIPTION OF THE DRAWINGS

Embodiments of the invention will now be described with reference to the accompanying drawings, in which numerical references denote like parts, and in which.

DETAILED DESCRIPTION OF THE PREFERRED EMBODIMENT

Figure 1:
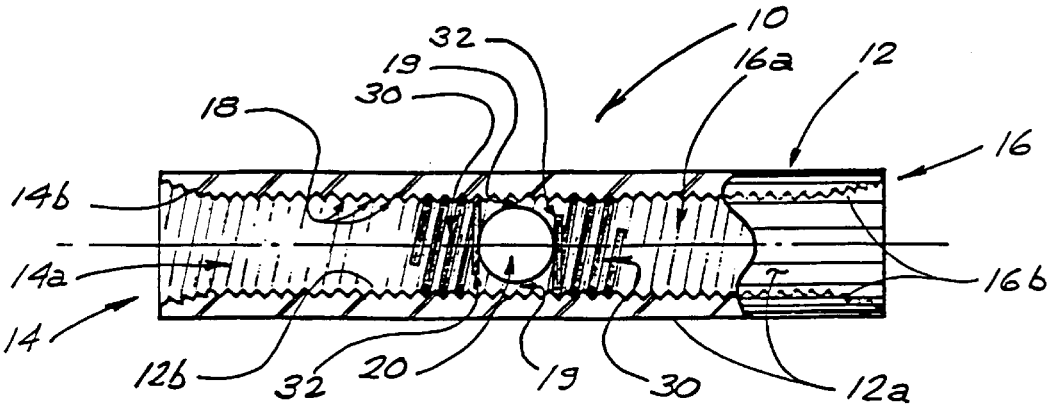
FIG. 1 is a partially cut-away side view of a preferred embodiment of the invention.

Referring to the Figures the fluid agitator (10) of the present invention comprises a cylindrical tube (12) having outer surface **(12*a*), inner surface (12*b*), inlet end (14), and outlet end (16). In the preferred embodiment inner surface (12*b*) has helical threads (18). A flow-disturber (20) is positioned within tube (12), such that the space inside the tube is divided into a fluid inflow chamber (14*a*) between the inlet end (14) of the tube (12) and the flow-disturber (20), and a mixing chamber (16*a*) between the flow-disturber (20) and the outlet end (16) of the tube (12). The fluid agitator (10) also comprises means for retaining the flow-disturber (20) in a desired position within the tube (12)**.

As illustrated in the Figures, the flow-disturber (20) of the preferred embodiment is a substantially spherical metal ball having a diameter slightly smaller than the bore of the tube (12). It has been observed in tests that optimal performance of the fluid agitator (10) may be achieved when the diameter of the metal ball (20) is approximately 0.014" smaller than the bore of the tube (12). In alternative embodiments of the invention, the flow disturber may be an oblong body with rounded ends and substantially circular in cross-section, although possibly of varying diameter. For example, the flow-disturber could be substantially cylindrical with rounded ends, or it could be an ellipsoid like a rugby ball or an egg. In such alternative embodiments, maximum diameter of the flow disturber will be approximately 0.014" smaller than the bore of the tube (12).

In the preferred embodiment, the metal ball (20) is retained in a desired position within the tube by means of two helical spring elements (30), sized and configured so that can mate with the threads (18) inside the tube (12). At one end of each spring element (30) there is a tab (32) disposed radially inward. The tabs (32) may be formed by simply bending down the ends of the material used to form the spring elements (30), or may be discrete elements connected to the spring elements (30) in some fashion. One spring element (30) is rotatingly inserted into the inlet end (14) of the tube (12), with the tab (32) of that spring element (32) facing the metal ball (20), and the other spring element (30) is similarly inserted into the outlet end (16), until the tabs (32) abut either side of the metal ball (20). The position of the metal ball (20) within the tube (12) may thus be adjusted by selectively manipulating the spring elements (30).

Figure 2:
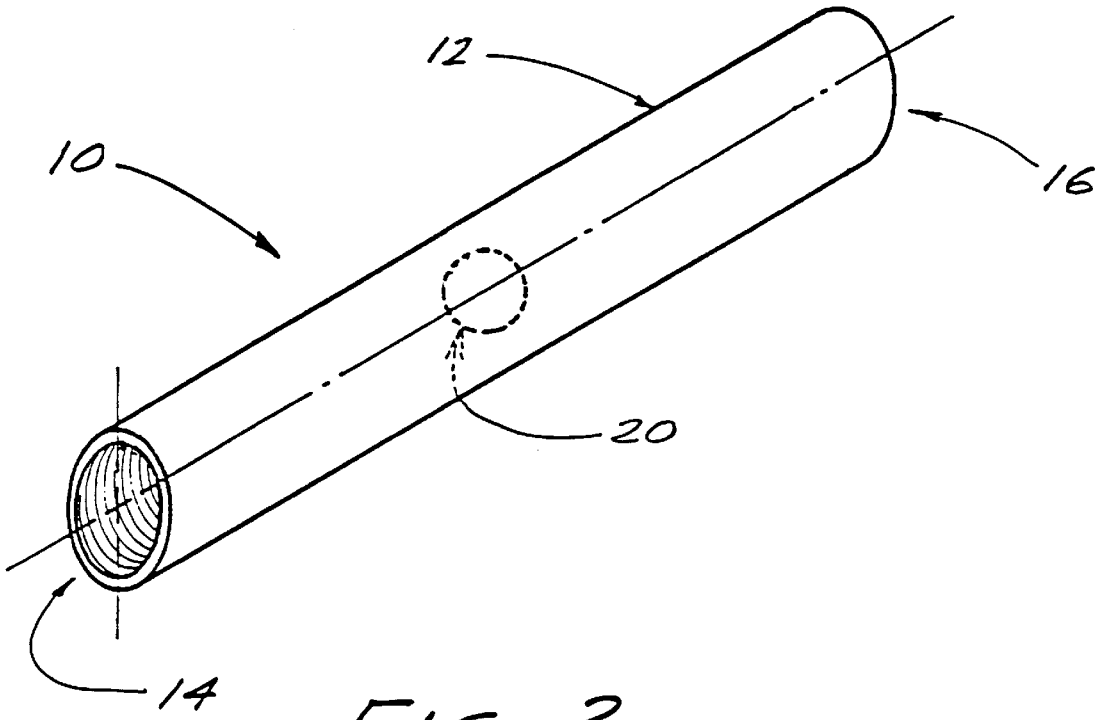
FIG. 2 is a perspective view of a preferred embodiment of the invention.

The fluid agitator (10) also incorporates means for providing fluid-tight connection of the inlet end (14) and outlet end (16) of the tube (12) to fluid supply and outflow lines (not shown). Such connection means may be provided in any of several ways well known in the art, but are shown for illustration purposes in FIGS. 2 and 3 as being tapered threads **(14*b* and 16*b*)**.

Figure 3:
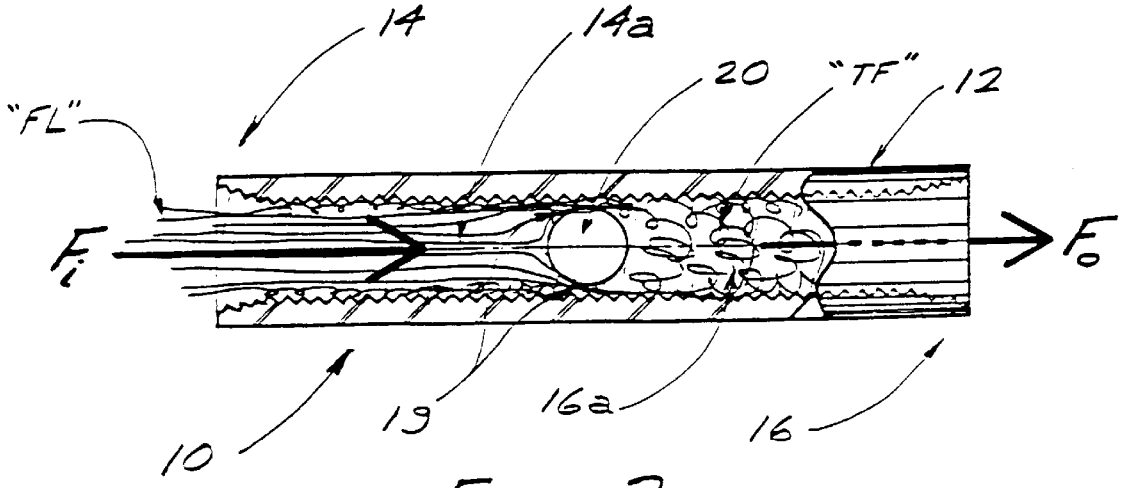
FIG. 3 is a simplified cut-away side view of a preferred embodiment of the invention, conceptually illustrating the operation of the invention as a fluid passes through it.

The operation of the invention is schematically depicted in FIG. 3 (in which spring elements (30) are not shown, for clarity of illustration). Arrow "$F_i$" denotes the flow of a fluid, such as gasoline or diesel fuel, into inlet chamber **(14*a*). Flow lines "FL" are intended to illustrate comparatively smooth flow of the fluid as it enters inlet chamber (14*a*). When the fluid reaches the metal ball (20), it is forced to pass through the constricted space (19) between the metal ball (20) and the inner surface (12*b*) of the tube (12). The velocity of the fluid increases significantly as it passes over and around the metal ball (20) into mixing chamber (16*a*). The fast-flowing fluid rapidly decelerates once it has passed by the metal ball (20) into the mixing chamber (16*a*). This deceleration, combined with turbulence generated by the shape of the metal ball or other form of flow-disturber (20), results in vigorous agitation and turbulent flow (conceptually illustrated by turbulent flow lines "TF" in FIG. 3) of the fluid within mixing chamber (16*a*) before the fluid exits the fluid agitator (10) through outlet end (16)**, as denoted by arrow "$F_o$".

The rough texture of the inner surface **(12*b*) of both the inlet chamber (14*a*) and the mixing chamber (16*a*) creates a swirling action and further turbulence in the fluid passing through the fluid agitator, thereby intensifying the agitation of the fluid. It can be seen, therefore, that the threads (18) of the preferred embodiment serve two complementary functions, firstly in providing the rough texture of the inner surface (12*b*) of the tube (12), and secondly in facilitating the use of helical spring elements (30) as the means for retaining the flow-disturber (20) in position within the tube (12)**.

The effectiveness of the present invention in reducing pollutant emissions in vehicle exhaust has been demonstrated by tests using a number of motor vehicles. Generally speaking, the characteristics of exhaust emissions from vehicle engines will vary according to a number of factors, including engine displacement, type of fuel used (i.e., gasoline or diesel), and whether the engine is carbureted or fuel-injected. In tests performed using a "Snap-On" brand emission testing machine, the hydrocarbon ("HC") and carbon monoxide ("CO") emissions (measured in parts per million, or "ppm") for a variety of engines, equipped with the present invention and operating at low speeds, were observed to have been reduced as summarized in the following table:

| Vehicle Description | HC (ppm) | CO (ppm) |
|---|---|---|
| 1980 Dodge 360 c.i. V-8, carbureted (gas) | | |
| without agitator | 154 | 3.58 |
| with agitator | 131 | 2.98 |
| 1989 Buick 3.8 L V-6, fuel-injected (gas) | | |
| without agitator | 338 | 0.93 |
| with agitator | 300 | 0.26 |
| 1990 Chevrolet 6.2 L V-8 (diesel) | | |
| without agitator | 9 | 0.04 |
| with agitator | 8 | 0.03 |

Tests have indicated that an embodiment of the invention with a 7/16" diameter flow disturber works effectively for engines with displacements up to 8 liters, while a ½" diameter flow disturber appears to work effectively for larger engines.

It will be readily seen by those skilled in the art that various modifications of the present invention may be devised without departing from the essential concept of the invention. In particular, although the present invention has been specifically described in terms of its application for use with fuel systems of internal combustion engines, those skilled in the art will readily appreciate that the invention may be easily adapted for other applications where it is desired to agitate fluids, or mixtures of fluids, including paints and dyes. All such modifications and adaptations are expressly intended to be included in the scope of the claims appended hereto.

The embodiments of the invention in which an exclusive property or privilege is claimed are defined as follows:

1. An in-line fluid agitator comprising:

(a) an elongate cylindrical tube having an outer surface and a rough-textured inner surface, and having an inlet end and an outlet end, wherein the rough-textured inner surface is disposed between the inlet end and the outlet end;

(b) a flow-disturber positioned within the tube between the inlet end and the outlet end, substantially but not completely blocking off the bore of the tube;

(c) retaining means for holding the flow-disturber in a desired position within the tube;

(d) an inflow chamber, being the space between the inlet end of the tube and the flow-disturber;

(e) a mixing chamber, being the space between the flow-disturber and the outlet end of the tube; and (f) means for providing fluid-tight connection of the inlet end and outlet end of the tube to a fluid inlet supply line and a fluid outflow line respectively.

2. The fluid agitator of claim 1 wherein the flow disturber is an oblong body having rounded ends, and having a maximum transverse diameter approximately 0.014 inches less than the inside diameter of the tube, plus or minus 0.002 inches.

3. The fluid agitator of claim 1 wherein the rough-textured inner surface of the tube is a helically thread inner surface.

4. The fluid agitator of claim 3 wherein the flow-disturber is a substantially spherical ball.

5. The fluid agitator of claim 4 wherein the diameter of the ball is 0.014 inches smaller than the inside diameter of the tube, plus or minus 0.002 inches.

6. The fluid agitator of claim 4 wherein the diameter of the ball is approximately 0.4375 inches, and the inside diameter of the tube is in the range between 0.4495 inches and 0.4535 inches.

7. The fluid agitator of claim 4 wherein the diameter of the ball is approximately 0.500 inches, and the inside diameter of the tube is in the range between 0.512 inches and 0.516 inches.

8. The fluid agitator of claim 4 wherein:

(a) the retaining means comprises two helical spring elements, said spring elements being of such dimensions and configuration that they may helically engage the internal threads of the tube; and (b) each spring element has, at one end, a tab disposed radially inward, such that the spring elements may be positioned inside the tube, one on either side of the ball, with the tab of each spring element abutting the ball.

9. An in-line fluid agitator comprising:

(a) an elongate cylindrical tube having a helically threaded inner surface and an outer surface, and having an inlet end and an outlet end;

(b) a substantially spherical ball positioned within the tube between the inlet end and the outlet end, the diameter of said ball being slightly smaller than the inside diameter of the tube;

(c) an inflow chamber, being the space between the inlet end of the tube and the ball;

(d) a mixing chamber, being the space between the ball and the outlet end of the tube;

(e) two helical spring elements, of such dimensions and configuration that they may helically engage the internal threads of the tube, each spring element having, at one end, a tab disposed radially inward, such that the spring elements may be positioned inside the tube, one on either side of the ball, with the tab of each spring element abutting the ball; and (f) means for providing fluid-tight connection of the inlet end and outlet end of the tube to a fluid inlet supply line and a fluid outflow line respectively.

10. The fluid agitator of claim 9 wherein the diameter of the ball is 0.014 inches smaller than the inside diameter of the tube, plus or minus 0.002 inches.

* * * * *